United States Patent [19]

von Schuckmann

[11] 4,437,591

[45] Mar. 20, 1984

[54] DISPENSER FOR, IN PARTICULAR, PASTY SUBSTANCES

[75] Inventor: Alfred von Schuckmann, Kevelaer, Fed. Rep. of Germany

[73] Assignee: Colgate-Palmolive Company, New York, N.Y.

[21] Appl. No.: 229,406

[22] Filed: Jan. 29, 1981

[30] Foreign Application Priority Data

Feb. 28, 1980 [DE] Fed. Rep. of Germany ..... 3007480

[51] Int. Cl.[3] ..... G01F 11/00

[52] U.S. Cl. ..... 222/391; 222/405; 222/509

[58] Field of Search ..... 222/391, 325, 404, 381, 222/384, 386, 509, 405

[56] References Cited

U.S. PATENT DOCUMENTS 2,639,052 5/1953 Gebauer et al. ..... 215/73
3,013,702 12/1961 Honisek et al. ..... 222/381
3,255,935 6/1966 Spatz ..... 222/340
3,774,816 11/1973 Bratton ..... 222/391
3,840,159 10/1974 Downey ..... 222/509

*Primary Examiner*—Joseph J. Rolla
*Assistant Examiner*—Michael S. Huppert
*Attorney, Agent, or Firm*—Herbert S. Sylvester; Murray M. Grill; John A. Stemwedel

[57] ABSTRACT

A dispenser, particularly for pasty products, including a tubular housing with a dispensing mouthpiece at one end and a piston displaceable within the housing toward the mouthpiece by means of a double-armed rocker lever located at the mouthpiece end having an operating handle on one arm and a draw means in the form of a rod connected to the other arm and coupled to the piston by means of a unidirectional-operating ratchet arrangement. The rocker lever may be provided with biased spring members to return the draw means to its rest position.

7 Claims, 3 Drawing Figures

FIG. 1
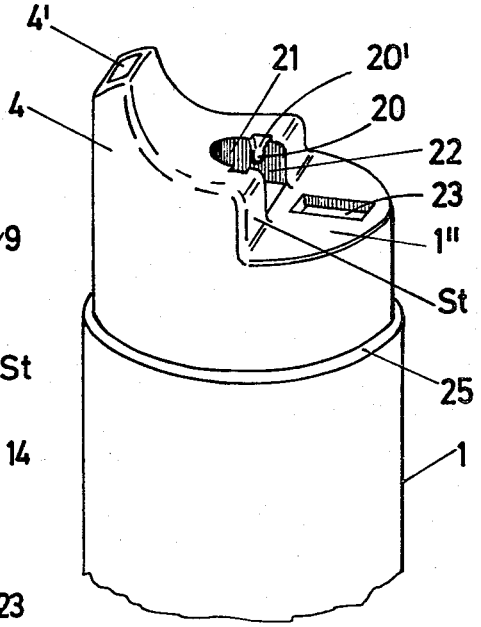
FIG. 3
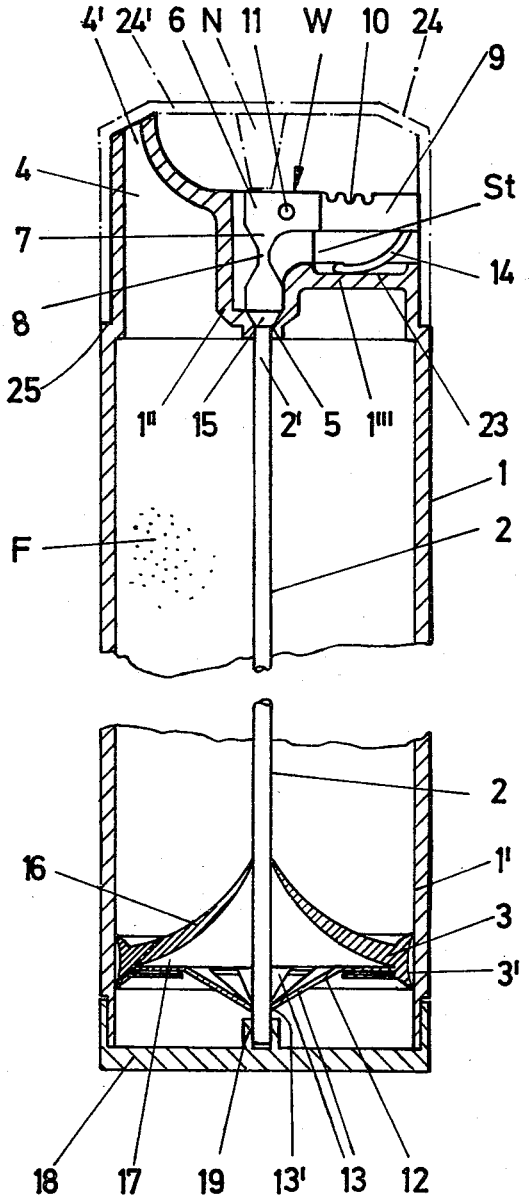
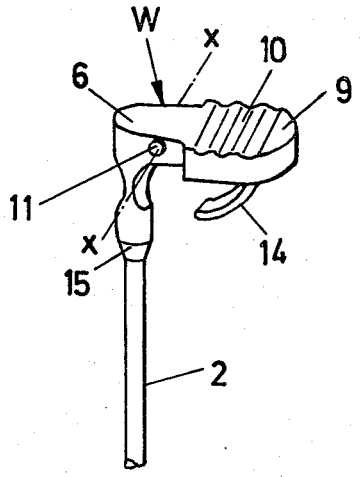
FIG. 2

DISPENSER FOR, IN PARTICULAR, PASTY SUBSTANCES

The invention relates to a dispenser, particularly for pasty substances, which comprises a tubular housing with a dispensing mouthpiece at one end, and a piston which is displaceable inside the housing towards the mouthpiece opening to force material out of the mouthpiece by means of an operating handle located at the mouthpiece end and a draw member linking the operating handle to the piston.

In known dispensers of this type (German Letters Patent No. 26 19 54), the operating handle consists of a shaft provided with a handle. The shaft is located in the area of the mouthpiece opening, and passes through the latter at right angles. The draw member consists of a band whose lower end grips the piston while the end located at the mouthpiece becomes wound around the shaft upon operation of the operating handle. A slide coupling is provided between the draw member and the shaft in order to allow the winding movement to occur only with the correct direction of rotation of the operating handle. Such constructions are complicated to manufacture. Their operation suffers from disadvantages. In particular, one handed operation is not possible. The loss factor based on the content of the dispenser is high because the shaft, including the slide coupling, occupies a considerable paste-filled space and because considerable amounts of the container's content still adhere to these structural parts, even when the piston is in a position corresponding to the fully emptied state.

In addition, dispensers for pasty substances are known (French Letters Patent No. 797,113) by which a piston is moved in a cylindrical housing by means of a rod, whereby the rod can be shifted by an outwardly extending operating handle and is connected with the piston by means of a ratchet member operative in one direction. These dispensers, which are a little simpler in construction, certainly allow single handed operation, however, they have the disadvantage that the operating handle is opposite the mouthpiece opening. This presents a considerable operating disadvantage, especially with larger dispenser housings. These dispensers are also disadvantageous insofar as the rod is pressure loaded during the working step of the operating handle, that is, during the dispensing process. It must, therefore, have considerable bending stability, which above all presupposes a relatively large cross-section of the rod, which cross-section is again lost as product fill capacity for the dispenser.

It is the object of the present invention to provide a dispenser of this type having a simplified, more convenient-to-use construction, and which is particularly easy to operate using one hand.

In accordance with the invention, a draw member is formed as a rod which is coupled with the piston via a unidirectionally-operating ratchet arrangement, the rod being coupled to one arm of a double-armed rocking lever mounted in the housing, and whose other arm forms the operating pressure surface. With this construction, a dispenser is provided which is easy to manufacture and advantageous to use. The draw member is formed as a rod which is coupled with the piston via a unidirectionally-operating ratchet arrangement. The rod is draw loaded during the working step. This has the advantage that such a rod can be formed with less cross-section than a rod standing under a pressure load, particularly in the case of greater housing lengths, where the danger of breaking of the rod cannot be excluded. The cross-sectionally reduced rod also meets the need with respect to saving of material. The discharge of the filling contents allows convenient-for-use small doses to be dispensed. The mouthpiece end of the rod is on one end of a double-armed rocking lever mounted in the receptacle, whose other arm forms an operating pressure surface. Such a rocking lever can be operated as an alternately pressurable pump lever by the operating finger pressing it in alternate directions. Since the mouthpiece opening can be in the immediate proximity of the rocking lever, such operation is immediately possible with the remaining fingers of the hand securely holding the container, so that discharge of the contents at accurately located positions is made possible. It is a structural advantage if the rod and rocking lever are formed of the same material as one piece. The joining zone between both operating parts, namely, the rod and rocking lever, is easily attained in that the rod has a bending zone of reduced cross-section in the area of its attachment. A one-piece rod and rocking lever assembly, formed out of correspondingly flexible, elastic material, is thereby also able to compensate for simultaneous linear and circular movements.

Instead of an alternating rocking lever operation, an easier, one-sided rocking lever operation can also simply result by spring biasing the rocking lever in the direction of its original rest position. A suitable return spring can be provided in the simplest manner by using the restoring force of the material used in such a way that the spring on the underside of the rocking lever is materially uniformly formed into a tongue. Mounting of the one-piece rod and rocking lever assembly can be accomplished without tools since the rocking lever is enclosed in the area of its shorter arm in a recess in a step, whose hollow side walls are provided with bearing openings for snapping in of the rocking lever's journals and whose longer arm protrudes above the step in such a way that its overlaps a portion of the surface of the upper front wall of the housing on which the spring braces itself. It is additionally advantageous if the end of the spring projects into a recess in the front wall of the housing. In order to ensure by simple means that the snap bearing remains unaffected during the impact of the piston—a shifting tendency arises in the direction of the rocking lever—an advantageous precaution is taken, namely that the rocking lever, snapped together with the housing is covered from above by a hold-down pin, disposed coaxially to the rod, and mounted on the inside cover of a protective cap sealing the mouthpiece. Such a protective cap can be screwed on using a quick thread arrangement. The corresponding hold-down pin is easily formed on the cap during an injection molding manufacturing operation. The protective cap fulfills a multiple function by covering the operating key against accidental contacts, guaranteeing axial immobility of the rod during the filling process, and sealing the mouthpiece so that the filling material cannot begin to dry or dry out in this area.

As an example of a dispenser constructed in accordance with the invention, reference is made to the accompanying drawings, in which FIG. 1 is a perspective view of the upper end of the dispenser;

FIG. 2 is a perspective view of the rod and rocking lever assembly; and

FIG. 3 is a broken longitudinal action through the complete dispenser, with the dispensing mechanism located in its rest position.

The dispenser takes the form of a tubular housing 1 with a smooth rod 2 passing centrally through it. A piston 3 travels thereon as a pressure base. The bearing surface 3' of the piston is guided on the cylindrical inner wall 1' of the housing 1.

The housing 1 forms an eccentrically located mouthpiece 4 in the area of its upper front wall 1" which finally tapers down in size to form a cross-sectionally reduced mouthpiece opening 4".

The front wall 1" of the housing 1 has a central aperture 5 through which passes rod 2. There, the rod then joins a rocking lever W. The double-armed rocking lever is such that its shorter arm 6 is connected with the axially shiftable rod over attachment 7 which is joined with the rocking lever and an adjoining joint position 8.

The other, longer arm 9 of the rocking lever serves as the operating surface. It is transversely grooved on the upper side in order to improve the grip. The grooving is labelled 10.

The joint position 8 takes the form of a bending zone, cross-sectionally reduced and situated between attachment 7 and rod 2 as a flexible hinge. The length of the cross-sectionally reduced bending zone allows for certain, slight transverse shifts, which result from the tilting movement of attachment 7 to the rocking lever W, as a result of the curved movement of the rocking lever.

The joint axis of the rocking lever W is marked x-x. The rod 2 is axially shifted in the discharge direction by pressing the rocking lever W in the area of the operating surface on top of the arm 9. It is, therefore, pulled during the dispensing step. The piston 3 is thereby pulled along by the rod 2, so that the pasty filling content F is dispensed in doses through the mouthpiece opening 4'. The length of stroke is about 1–2 mm.

The piston is provided with a unidirectionally-operating ratchet arrangement. The latter consists of a spring disc 12 located on one broadface of the piston 3. This spring disc has radially inwardly directed tongues 13. The tongues 13 are equiangularly arranged and are inclined with respect to the transverse plane corresponding to the position of the piston in such a way that their forward edges 13' bear under spring force against the outer surface of rod 2 at a position which is displaced from this plane. Their inclination is directed away from the mouthpiece side. The piston 3 is, as a result, only pulled along by rod 2, drawn axially in the direction of the mouthpiece, when pressing the longer arm 9 of rocking lever W.

After subsequent release of the rocking lever W, it returns to its original rest position as a result of the restoring effect of spring 14 which is materially uniformly shaped as a tongue on the underside of the rocking lever, that is the underside of the longer arm 9. It is rooted in the free end of this arm and runs in a curved manner in the direction of the rod 2. The spring 14 can have a certain initial tension. In order to define the original rest position exactly, the relatively cross-sectionally thin rod 2 has, in the area of the opening 5 in the housing's front wall, a truncated conical thickening 15, which is inserted in a suitably adapted, funnel-shaped widening of opening 5.

With this rocker lever restoring force, the piston 3 is not moved. Rather, as a result of the force of spring 14, the rod returns to its original rest position. The reason therefore is that the piston "sticks", on the one hand, to the filling contents and, on the other hand, the peripheral friction surface prevents a corresponding carrying-along of the piston. The springingly adjacent tongues 13 freely slide thereby over the outer surface of the rod 2.

Since the piston 3 further forms, at its side facing the mouthpiece-opening, a sealing lip 16 which extends to the outer surface of the rod 2, a passage of the filling content F to the opposite side of the piston is also prevented with certainty, so that no losses occur. The corresponding previously inverted sealing lip 16 continues to the section forming the actual piston sliding surface 3' in a chamber 17, situated on the side facing away from the direction of discharge, in order to insert the spring disc 12. Snap tongues could be used here. The spring disc 12 can obviously be molded into the elastic piston body.

The free end of the rod is located in a centrally lying sleeve 19 formed on a cover 18 of the container 1, which has such a height in relation to the axial stroke of the rod that axial movement of the rod is maintained there when the piston 3 is further shifted in the direction of discharge.

The cover can be closed by snap mounting. It also has a pressure-equalizing opening which is not illustrated in detail.

The rocking axle x-x is provided by stub shafts 11 laterally formed on the rocking lever W. The axle stub shafts snap into corresponding bearing openings 20 provided in the sides 21 of a recess 22 when the rocking lever is mounted. The corresponding recess is located in the area of step St in the front wall 1" of the upper housing. The horizontal rocking lever bearing, lying transversely to the rod 2 as well as being offset relative to it, is provided in the upper area of the recess 22 so that on the basis of the step and the front wall section 1", which is lower and disposed therewith opposite the upper recess zone, an operating free-space exists for the lowering of the longer arm 9. The longer arm protrudes correspondingly over the step St. As clearly seen in FIG. 1, a portion of the surface of the housing front wall 1", overlapped by the longer arm, is formed with a slotted depression (23), into which the free end of spring 14 seats.

A guiding channel 20' open to the top and spreading laterally beyond the sides of recess 22 is located above the bearing openings 20 so that mounting of the rocking lever is practically self centering. The opening of the guiding channel 20' is, however, a smaller width than the diameter of the bearing opening 20 so that the illustrated snap mounting is attained.

In order to be able to empty all of the filling contents, the discharge side of the housing can essentially be formed corresponding to the contour of the piston's sealing lip 16.

The entire dispenser head is covered by a protective cap 24, which is, in the direction of attachment, bound when affixing a shoulder 25 formed at the level of the front wall 1" of the housing.

All structural parts are appropriately manufactured out of thermoplastic synthetic material by injection molding.

The protective cap 24 has a hold-down pin N (compare FIG. 3) projecting from the inside of its cover 24'. The hold down pin is formed directly on the cap. The distal surface of the pin, which extends conically, terminates directly above the arm 6 of the rocking lever W. The purpose of this arrangement is to prevent the stub shafts 11 formed on the rocking lever from being pressed out by the impact of the piston 3. This cannot be excluded in cases in which the snap forces, on the basis of possibly different tolerances, are not sufficient for snap mounting situated in the direction of the rod. In such cases, the hold down pin forms an abutment able to withstand the corresponding forces. The protective cap 24 itself is held to the housing itself by use of a short screw thread.

As is further seen from FIG. 3, the protective cap is formed with a deep bevel-edge in the area where its top and sidewalls meet. This bevel-edge is adapted to the inclination of the mouthpiece opening rim so that a tight sealing closure, which prevents drying out of the filling contents, is attained.

The hold-down pin N is coaxial to the centrally mounted rod 2.

I claim:

1. A dispenser, particularly for pasty substances, which comprises a tubular housing with a dispensing mouthpiece at one end and a piston which is displaceable inside the housing towards the mouthpiece to force material out of the mouthpiece by means of an operating handle located at the mouthpiece end and a draw member linking the operating handle to the piston wherein the draw member is formed as a rod which is coupled with the piston via an unidirectionally-operating ratchet arrangement, the rod being coupled to one arm of a double-armed rocking lever mounted in the housing and whose other arm forms an operating pressure surface, and wherein the rocking lever is enclosed in the area of its shorter arm in a step whose hollow side walls are provided with bearing openings for snapping in of the rocking lever's journals and whose longer arm protrudes above the step in such a way that it overlaps a portion of surface of an upperfront wall of the housing on which a spring braces itself.

2. The dispenser according to claim 1 wherein the rod and rocking lever are formed of the same material as one piece.

3. The dispenser according to claim 2 wherein the rocking lever is returned to its original rest position by spring biasing.

4. The dispenser according to claim 3 wherein the spring on the underside of rocking lever is materially uniformly formed into a tongue.

5. The dispenser according to claim 1 wherein the rod has a bending zone of reduced cross section in the area of its attachment.

6. The dispenser according to claim 1 wherein the end of the spring protrudes into the front wall of the housing.

7. The dispenser according to claim 1 wherein the rocking lever, snapped together with the housing is covered from above by a hold down pin, disposed coaxially to the rod, and mounted on the inside cover of a protective cap sealing the mouthpiece.

* * * * *